US006009784A

United States Patent [19]

Pizzi et al.

[11] Patent Number: 6,009,784

[45] Date of Patent: Jan. 4, 2000

[54] DEVICE AND METHOD FOR PROCESSING PLY MATERIAL

[75] Inventors: Fausto Pizzi; Gilberto Forni, both of Bologna, Italy

[73] Assignee: bielomatik Leuze GmbH & Co., Germany

[21] Appl. No.: 08/882,448

[22] Filed: Jun. 26, 1997

[30] Foreign Application Priority Data

Jun. 28, 1996 [DE] Germany ..... 196 25 818

[51] Int. Cl.[7] ..... B26D 5/00; B26D 7/14; B26D 1/18

[52] U.S. Cl. ..... 83/428; 83/76.1; 83/76.9; 83/425.2; 83/488; 83/491; 83/500; 83/559

[58] Field of Search ..... 83/73, 76.4, 76.7, 83/76.9, 425, 425.1, 425.2, 428, 433, 483, 485, 486.1, 487, 488, 489, 491, 492, 495, 500, 508.2, 508.3, 559, 560, 663, 673, 676, 471.2, 471.3, 472, 473, 477.1, 76.1

[56] References Cited

U.S. PATENT DOCUMENTS

| | | | |
|---|---|---|---|
| 2,439,794 | 4/1948 | Bugatti | 83/483 X |
| 3,282,525 | 11/1966 | Rehr | 83/428 X |
| 3,296,911 | 1/1967 | McLane | 83/408 |
| 3,485,128 | 12/1969 | Siegenthaler | 83/483 X |
| 3,540,340 | 11/1970 | Koskela | 83/560 X |
| 3,776,072 | 12/1973 | Gerber et al. | 83/34 |
| 4,257,298 | 3/1981 | Aykut | 83/482 |
| 4,266,112 | 5/1981 | Niedermeyer | 83/428 X |
| 4,607,552 | 8/1986 | Siler | 83/76.7 |
| 4,638,701 | 1/1987 | Oberlander et al. | 83/428 X |
| 4,737,904 | 4/1988 | Ominato | 83/73 X |
| 4,922,775 | 5/1990 | Winter | 83/333 |
| 5,099,732 | 3/1992 | Hashida et al. | 83/369 |

FOREIGN PATENT DOCUMENTS

| | | | |
|---|---|---|---|
| 0 593 964 A1 | 4/1994 | European Pat. Off. . | |
| 0 692 370 A1 | 1/1996 | European Pat. Off. . | |
| 68724 | 6/1958 | France | 83/433 |
| 458822 | 4/1928 | Germany . | |
| 641 938 | 2/1937 | Germany . | |
| 1 092 292 | 11/1960 | Germany . | |
| 1454971 | 9/1970 | Germany . | |
| 25 26 599 C2 | 1/1976 | Germany . | |
| 27 52 648 A1 | 5/1979 | Germany . | |
| 32 092 914 A1 | 8/1983 | Germany . | |
| 33 03 252 A1 | 9/1983 | Germany . | |
| 32 38 952 C2 | 4/1984 | Germany . | |
| 32 44 402 A1 | 10/1984 | Germany . | |
| 3443849 | 6/1986 | Germany | 83/425 |
| 42 18 272 A1 | 10/1992 | Germany . | |
| 34 23 674 C1 | 11/1995 | Germany . | |
| 44 15 291 A1 | 11/1995 | Germany . | |
| 44 21 011 A1 | 1/1996 | Germany . | |
| 44 25 155 A1 | 1/1996 | Germany . | |
| 2072563A | 3/1981 | United Kingdom . | |

*Primary Examiner*—Rinaldi I. Rada
*Assistant Examiner*—Boyer Ashley
*Attorney, Agent, or Firm*—Quarles & Brady

[57] ABSTRACT

A device for processing ply material comprises a stationary device base; first and second transverse slides, first and second working units, and a controller. The first and second transverse slides are simultaneously displaceable in first and second contour directions on the device base, the second contour direction opposing the first contour direction and the contour directions oriented transverse to the length direction and parallel to a layer plane. The first and second working units each include respective first and second tool units, from opposing sides of the ply material the first and second tool units simultaneously processingly engaging ply material at first and second working points, the tool units define first and second working planes oriented transverse to the ply material and transverse to the first and second contour directions, the first working unit being pivotably mounted on the first transverse slide about a first contour axis through the first working point and oriented transverse to the layer plane, the second working unit being pivotably mounted on the second transverse slide about a second contour axis through the second working point and oriented transverse to the layer plane. The controller commonly and positionally varies the first and second working units with respect to the device base while in the operating state. The controller includes a driving member, a setting motor, and a pivot motor.

24 Claims, 4 Drawing Sheets

DEVICE AND METHOD FOR PROCESSING PLY MATERIAL

TECHNICAL FIELD AND BACKGROUND OF THE INVENTION

The invention relates to a device with which ply material such as paper, film or the like can be processed, transported and/or divided. The ply material is flexible and may have a weight per surface unit of less than 500, 200 or 100 g/M$^2$, suitable for example as packaging material, with which a package, such as a stack of paper may be tightly wrapped. Processing may be done by cutting, perforating, crimping, embossing or the like by which the cross-section of the material is altered in the processing region.

It is especially important in the production of rectangular or similar package sheets that the material is drawn as a web from a storage device, such as a reel, and continuously fed to one or more slitters which sever on one or both longitudinal sides of the web an edge strip from the web so as to define the desired width of the package sheet. After slitting, the web is divided into the separate sheets by cross cuts. After which, the sheets are either stacked or fed directly to a packaging station in which they are folded in sequence about units to be packaged so that each unit is entirely enveloped.

To adapt the sheets to packaging units which have varying widths or to place a slit in varying width zones of the material, at least one length slitter is transversely adjustable and then lockable in a working position. This requirement applies also to every other straight-line processing actions in which the working width is substantially smaller than half or a tenth of the material width.

With current devices before a transverse adjustment can be made, the cutting tool is disengaged from the material and then adjusted before being returned into engagement with the material. Thus, after a transverse adjustment has been made, the two lines created by the tool which are transversely offset from each other are not continuously connected to each other because a corresponding transverse processing action has not occurred. In the case of a cutting action, the leading end of one slit and a trailing end of the other slit are then not connected to each other via a continuous connecting cut. As a result, the two sections of the edge strip adjoining each other remain joined to the remaining material end and need to be severed to allow the edge strip to be swept away as a waste strip from the remaining material. In addition, to make the transverse adjustment, the conveying movement of the material web needs to be interrupted. This creates long stoppages in processing of the material.

OBJECT OF THE INVENTION

It is an object of the invention to provide a device in which the disadvantages of known methods or of the kind described are prevented. In particular, it is an object of the device to provide for a transverse adjustment of a working point in a shorter period of time and/or without halting the device.

SUMMARY OF THE INVENTION

In accordance with the invention, these and other objects are provided by a control means for maintaining the respective tool unit in direct engagement with the material during the transverse adjustment and to continue the continuous longitudinal feed movement between the tool unit and the material at the same and/or slower speeds. As a result of this control, the need to disengage the tool unit or to halt a feed movement during transverse adjustment can be avoided.

Where the tool unit is configured so that it requires predetermined track orientation for processing namely an orientation parallel to the processing line, the tool unit is expediently infinitely continuously adjustable with respect to this track orientation. Similar to a steered wheel of a vehicle, the tool unit is pivotable about a sole contour axis oriented at right angles to the material plane. This axis passes through the engagement zone in which the tool unit processes the material. The steering deflection, the conveying movement and the feed movement can be combined so that the parallel offset motion of the two slits are joined directly to each other. This starting cut is oriented at an acute angle to the length slits. The superimposition also permits, however, a polygonal or curved connecting cut or a corresponding other processing action which may cover only a part of the material width or the full material width. Thus, linear processing may also be implemented at right angles to the material web with the otherwise longitudinally processing tool, for example a complete cross cut can be achieved.

The tool unit comprises two tools located directly opposite each other on both sides of the material. During processing, these tools are able to simultaneously engage the material on both sides and/or interengage directly under pressure or pretension, or counter-rotate. Both tools commonly execute the feed movement, the transverse movement and/or the steering movement so that their mutual relative position always remains the same. In this arrangement, one of the tools may be provided to support the material during processing or against the processing pressure of the other tool. In the case of a cutter, this tool forms a shear edge that does not pass through the material, instead the other tool passes through the material. The holders or bearings of the two tools are rigidly connected to each other via a carrier. During processing, the carrier is located laterally outside of the material still to be processed or already having been processed and may be mounted only on one of the two sides of the material plane in steering bearings.

The steering or contour axis passes through the material. The portion of the carrier which traverses the material plane is displaced with respect to the steering axis and the working point in the feed direction, more particularly, in the feed direction of the material. Hence, this portion is located permanently in the region of the already processed material section and the material plane directly adjacent to the associated material side edge. When a cut is implemented, the cited carrier portion is then always located with a slight spacing adjacent to the cut edge of the material art which continues to in the material plane.

The tool unit, its holder, or its bearing is arranged on a cross-slide mounted to travel parallel to the material plane and at right angles to the feed direction. This slide, or its bearing, is located on the side of the working point facing away from the cited carrier portion with respect to the feed direction, for example upstream of this processing point. In this arrangement, the spacing of the slide bearing from this processing point or from the steering axis may be smaller than the spacing of the carrier portion passing through the material plane.

For implementing the steering movement, pivot motor means are provided. The pivot means can include a drive, for example a linear drive such as a fluid drive. This drive also executes the transverse movement and is mounted on the slide. This positioning or steering drive may be controlled so that it, on commencement of the transverse movement, i.e. during the short impulse acceleration up to the otherwise constant speed of the transverse movement, executes the steering movement and change in the orientation of the tool unit. Thereafter, during the constant transverse movement, no steering movement occurs. The steering movement also operates accordingly in the case of a negative acceleration during which the constant transverse movement is halted. The counter oriented steering deflection then leads back to the tool orientation as existing prior to the transverse movement. In each of these two end positions the steering movement may be rigidly fixed by a stop so that highly accurate orientation is achieved despite the rapid steering movement.

It is of advantage when the position of the stops can be varied by adjustment to vary the steering deflection. In the case of a straight-line slanting processing action, the constant speed of the transverse movement is expediently equal to the tangent of the slant angle with which the processing action is carried out multiplied by the feed speed. It is of advantage when the slant angle relative to the feed direction is not more than 60°, 30° or 20° and at least 3° or 5°, preferably roughly 10°. Two working units are provided on both sides of the longitudinal center plane of the material or the like. The working units are identical or different, or arranged symmetrical for processing the material simultaneously at two separate processing points. These points are provided in a common transverse plane oriented at right angles to the longitudinal center plane.

These working units are transversely movable independently of each other and/or in synchronism counterwise. For this purpose the setting motor means may be provided as a separate transverse drives or as a single, common transverse drive. The slide bearings of these working units may be oriented flush. Guides or runner rails fixedly secured to the frame for the transverse movements may be rigidly secured to a device base or between the side cheeks thereof. These cheeks stand laterally outside of the material width.

Irrespective of the configuration described and according to the invention the ply material and the tool unit are mutually and transversely displaced without interruption or delay of the feed movement. Even when the tool unit is thereby driven out of processing engagement by motor means, a substantial reduction in time would nevertheless result for the transverse adjustment as compared to a method in which the feed for the transverse adjustment is interrupted. The longitudinal section of the material not processed during the transverse movement, like the longitudinal section provided with transverse processing treatments, may then be severed from the material web by cross cuts directly connecting to its two ends and executed by a separate tool of the device. This section can be then discharged as waste.

The movements to be superimposed are expediently controlled electronically or via a computer with a processor. The movements or their speeds are detected by sensors and signaled to the processor via signal leads. A corresponding signal lead may also bring about the measurement values of a material processing station located downstream of the working units in the running direction to the processor and thereby activate given programs for the movements to be superimposed. For example, in the packaging station the size of the individual package unit may be sensed and then the material web can be automatically variably processed lengthwise in the respective width zone. Accordingly, while continuously passing material sections in sequence and of varying width may be produced with a common longitudinal center plane. Therefrom, the edge strips spaced from both sides of the longitudinal center plane can be severed continuously interconnected, despite including longitudinal sections differing in width. A substantial time saving is also achieved when the feed movement is halted for the transverse adjustment but the tool unit or the separate tool remains processingly engaged with the material.

These and further features are also evident from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DETAILED DESCRIPTION

Figure 1:
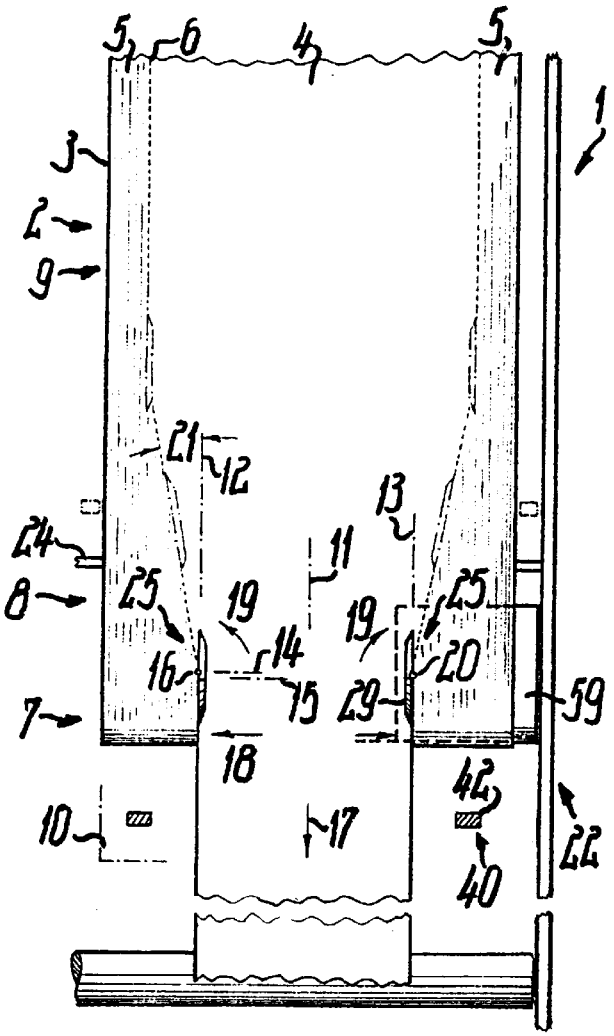
FIG. 1 is a simplified illustration of the device according to the present invention in plan view at right angles to the material plane.

The device 1 serves to process a web of substrate material 2 of constant width supplied continuously from a reel storage. The longitudinal edges 3 of the substrate material are oriented parallel to each other. While continuously moving, however, the material 2 is simultaneously processed under permanent tensile stress which is adjacent and parallel to each of the two edges 3 along a respective processing line 6. The material may also be processed along only a single line 6. From one line 6 to an opposite line 6 or the associated edge 3 the material 2 then forms a strip 4 of material which has a width which is narrower than the initial material 2. The strip 4 is intended to be further processed into single sheets or the like which are separated or bounded from each other by transverse cuts, perforations or the like. Adjoining the side of each line 6 which faces away from strip 4 are narrow edge strips 5 which can be moved transversely away as waste. The width of individual strips 4, 5 can be varied symmetrically with respect to the longitudinal center plane 11 of the material 2 during the movement of the material during processing. However the combined width of strips 4 and 5 remains the same since a widening of strip 4 results in each strip 5 becoming narrower by half of this widening; same applies conversely when strip 4 becomes narrower.

FIG. 1 illustrates transitioning from a narrow width to a wider width, with the dotted lines indicating the transition from narrow to wider processing. In the region of the narrow processing, strips 4, 5 and lines 6 form longitudinal sections 7 having exclusively parallel edges. In the transition portion, the longitudinal sections 8 have slanting edges. In the region of the wider strip 4, the longitudinal sections 9 again have edges that are parallel to each other. In the length direction 17 of the material 2, each of the strips 4, 5 as well as lines 6 continue uninterruptedly through sections 7, 8 and 9 via which strips 5 are uninterruptedly separated from the strips 4.

During processing, the material 2 is guided in a horizontal material plane or layer plane 10. The material is also being fed with a constant speed and a maintained tensile stress which is parallel to its length direction and to plane 10. The reference or center plane 11 is oriented at right angles to plane 10 and is also oriented parallel to the length and conveying direction 17 of the material 2. While producing all sections 7 to 9 each line 6, or the tool unit producing the line 6, which define processing planes 12 and 13 respectively oriented at right angles to plane 11. In producing section 8, planes 12, 13 are oriented at acute angles of 10° to plane 11, both slanting planes then being symmetrical to plane 11.

The processing of the two lines 6 is done in the region of processing points 16 which are less than 10 or 5 mm wide and justaxposed at right angles to plane 11. Each point 16 can be processed with just a single tool or with two tools located on both sides of plane 10. Each of these tools comprises a zone of maximum approximation to plane 10 or of maximum penetration of plane 10. This zone is located in planes 14 and 15 oriented at right angles respectively to planes 10, 11. Planes 14 or 15 can be an axial plane of the corresponding tool and therefore in FIGS. 1 and 2 these planes illustrate tool axes 14, 15. The two planes 14, 15 are slightly offset from each other in the feed direction 17 of the material 2. They are particularly offset such that the axial plane 14 of the tool not passing through the material 2 and located on the material underside is offset in a counter direction 17 relative to the axial plane 15 of the other tool which cuttingly penetrates the material 2 from its other side. Thus, the upper side cooperates shearingly with the tool located below. Points 16 then lie between planes 14, 15 and are defined by the zone in which the material 2 is engaged by both tools initially at the same time.

The two cooperating tools form tool units 28, 29 of a working unit 25 and are held on separate working heads 26, 27 or are mounted movable. Preferably, the tool units 28, 29 are particularly rotatable. One tool 28, particularly the lower tool, comprises a cylindrical circumferential face which linearly supports the material 2 and is overengaged at one end face. Where necessary this is accomplished with slight axial contact tension by the other or upper tool 29. This tool 29 forms on the outer circumference a circular sharpened cutting edge located directly in that end face of tool 29 which faces the cited shear and end face of tool 28 with which it cooperates. The rotation axes of tools 28 and 29 are in planes 14, 15 and are always oriented parallel to each other. When tools 28 and 29 are oriented parallel to plane 11 and direction 17, their axes are oriented at right angles to plane 11. Thus the two tools 28, and the two tools 29, of the two units 25 are coaxial.

When units 25 are oriented slanted relative to plane 11, the axes of tools 28 and 29 are oriented at an obtuse angle to each other or at an acute angle to plane 11. The working diameter of tool 28 may be slightly larger than that of tool 29. The two tools 28 and 29 form by their circumferential zones opposing gap or tool boundaries and an inlet funnel for the material 2.

Points 16 can be moved simultaneously and in synchronism in opposing first and second contour directions 18 oriented at right angles transverse to plane 11 and parallel to plane 10. Hence points 16 are always the same distance away from plane 11. Furthermore, each unit 25 can be pivoted about a single first or second contour axis 20 oriented at right angles to plane 10 or to direction 17 and parallel to planes 11 to 15. The axis 20 may be located in the respective plane 14, 15 and oriented at right angles to the tool axes and, more particularly, coincide with the point 16.

The pivot motions of the two units 25 about the steering or contour axes 20 occur counterwise in synchronism in pivot or contour directions 19, so that units 25 always assume the same angles relative to plane 11. The orientation of units 25 parallel to plane 11 represent a center position from which the two units 25 can be swivelled with stop-limiting in both opposing directions by the same angular amounts so that a very simple control is achieved. Starting from this center position the maximum pivot angle in this case in each direction is preferably 10°, but the pivot angle may also amount to more than 40° or 90°.

According to FIG. 1, a narrow section 7 of strip 4 is cut during the continuous feed of the material in direction 17 by simultaneously processing the material 2 at both points 16. If strip 4 needs to be widened, units 25 are simultaneously oriented with equal speeds about points 16 in directions 19 towards the diverging slanting tracks of section 8. At the same time, they are moved away from each other in directions 18 while processing is continued without interruption at points 16.

The pivot motions about axes 20, which are located in the planes of the processing end faces of the respective tools 28 and 29, occur only via a slight portion of the length of the slanting sections 8 of lines 6 so that the transition to these slanting sections is not or only very slightly rounded.

In further course, the slanting sections 8 of line 6 are cut while the feed movement and the transverse movements are continued. As soon as, or shortly before points 16 of units 25 have attained the desired spacing therebetween, corresponding to the largest width of strip 4 or the greatest spacing of lines 6 in section 9, the units 25 are returned to an orientation parallel to plane 11. This return steering movement at the end of the slanting section 8 too, occurs, like the deflection at the start thereof, so that the ends of the slanting section 8 translate into sections 9 of lines 6 with slight or no rounding. Strip 4 can now be further processed or cut continuously with the changed, but now constant width, which in this case is larger.

Between the two sections 7, 9 of constant width strips 4, 5 the section 8 has continuously changing width and joins sections 7, 9 in one part. Section 8 can be severed from material 2 downstream of device 1 by cross cuts. The strip 4 can conversely also be made correspondingly narrower at any time. Strips 5, which are continuously severed from strip 4 despite the change in width, are deflected downwards and transverse to plane 10 directly after points 16 or tools 28 and 29 and are there directly transferred into a container.

The device 1 comprises a base frame or device base 22 to be rigidly arranged on a foundation bed. This base preferably contains two side cheeks positioned laterally outside of the material width and oriented parallel to plane 11. Cross members 24 rigidly connect the two cheeks to each other. Substantially all components of the device 1 can be fixed or mounted directly on frame 22 or on the cheeks. The device 1 may also be a preassembled unit, however, which is to be interchangeably arranged as a module on the upper side of the foundation base and which can be inserted and removed at right angles to direction 17 or parallel to plane 10.

Figure 2:
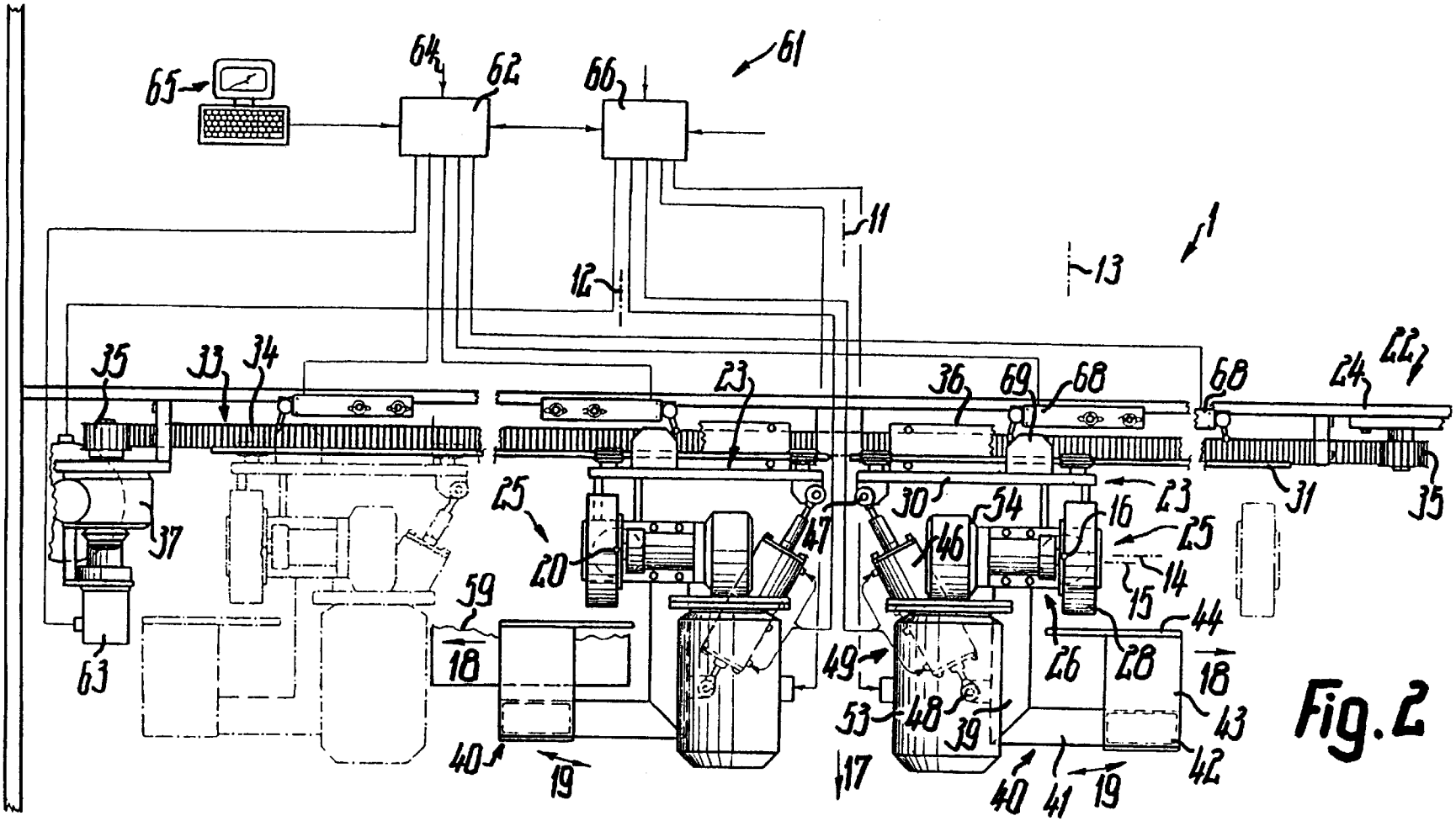
FIG. 2 is an enlargement of a part of the device shown in FIG. 1, without the material web and without the upper tool.
Figure 3:
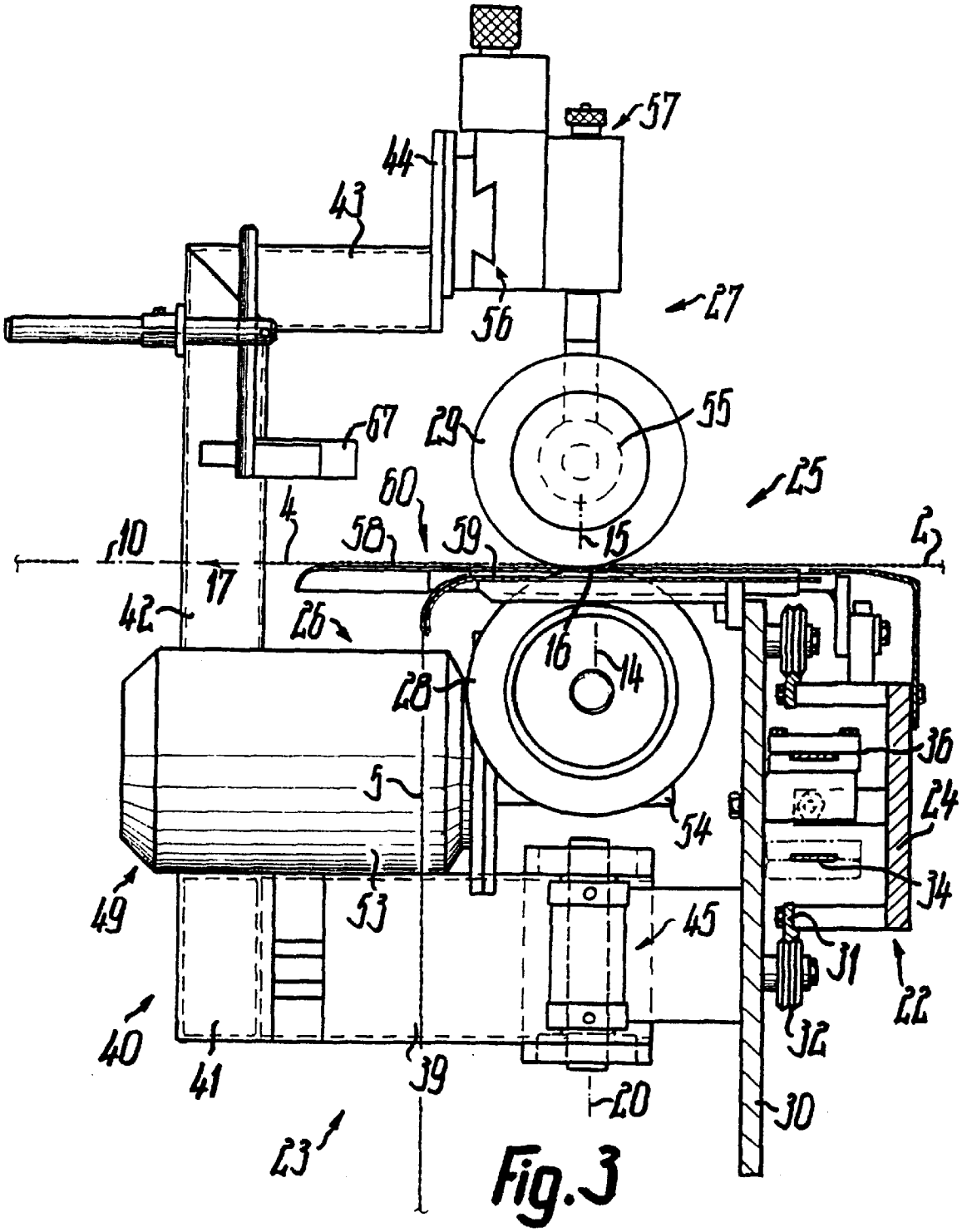
FIG. 3 is an enlargement of a section through the device taken parallel to the length feed in FIG. 2.

In this case frame 22 is a dimensionally stiff frame of the device module 1 and separate from the foundation base frame. The cheeks of this module are coplanar with those of the foundation base and are rigidly tensioned to the foundation base during processing. In any case plane 10 is expediently located with a spacing above the cheeks so that the material 2 and points 16 are freely accessible at all times. Mounted between the cheeks and thereon or on a cross member 24 are two identical transverse slides 23 which are always located mirror symmetrical on both sides of plane 11 and can be reciprocated in directions 18. Slides 23 are indicated in FIG. 2 by solid lines in their end position of nearest approximation to plane 11 respectively by dot-dashed lines in their end position spaced furthest away from plane 11.

Figure 5:
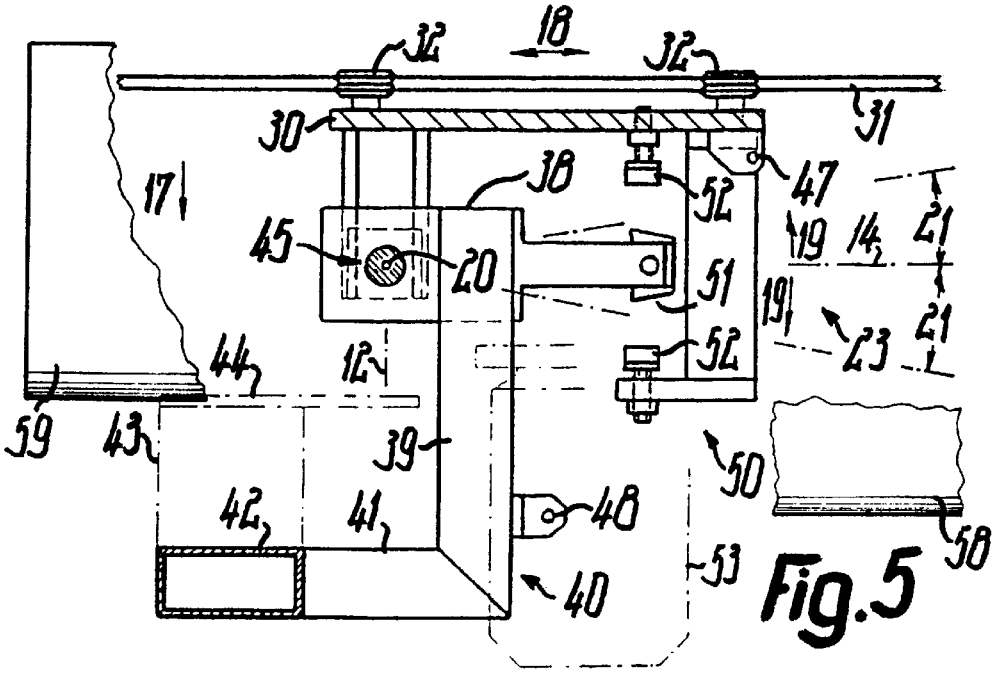
FIG. 5 is a section parallel to the material plane in FIG. 4 and without tools.
Figure 4:
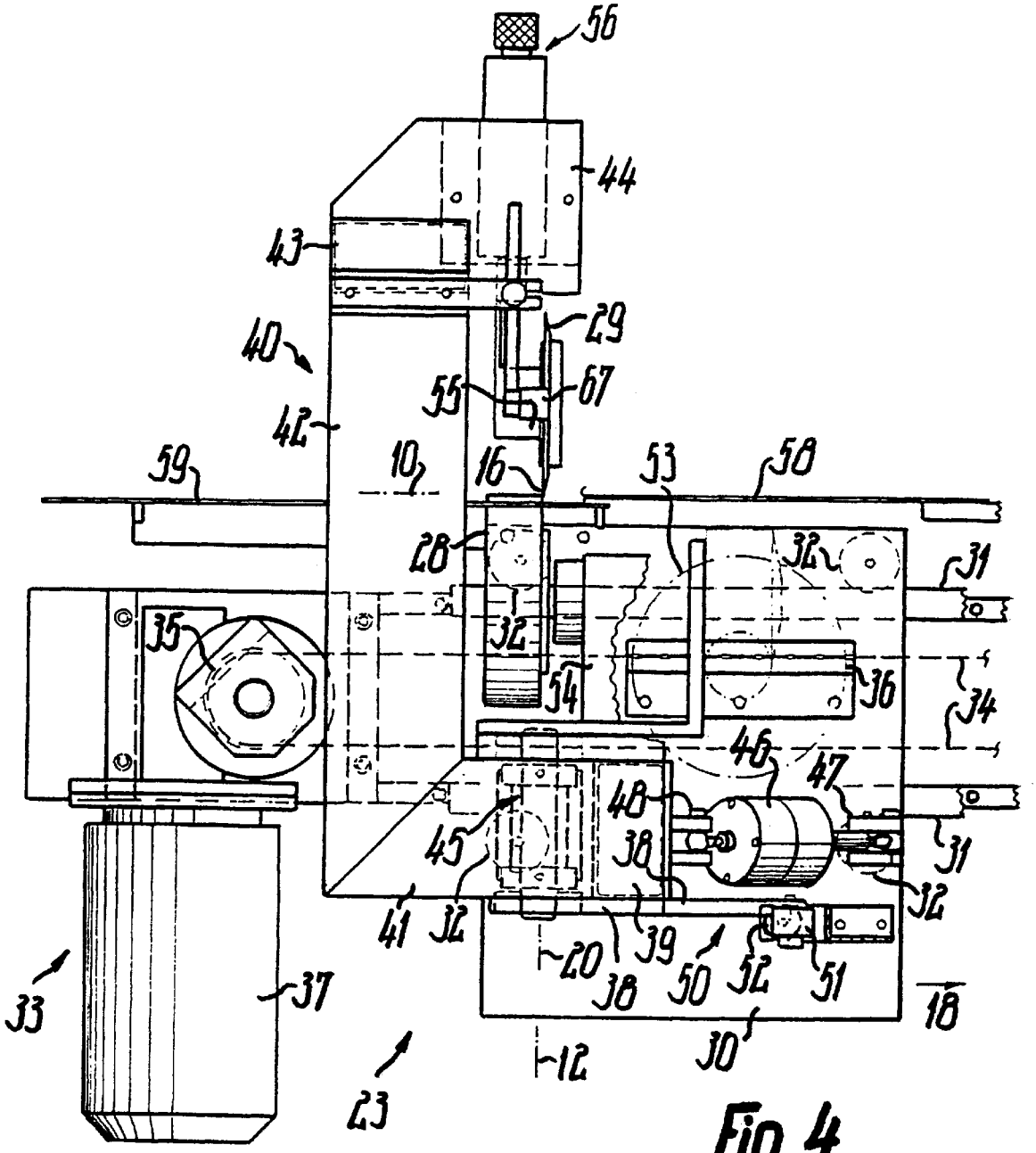
FIG. 4 is an illustration of the working unit shown on the left in FIG. 2 and in a view counter the length feed as well as in the laterally outermost end position.

In FIG. 4 the left-hand slide 23 is illustrated in its end position spaced furthest away from plane 11. For better clearness only the lower tools 28 of units 25 are illustrated in FIG. 2. In FIG. 5 the associated unit 25 is not illustrated to better show the parts located thereunder. Swivably mounted about the axis 20 on each slide 23 is one of the two units 25. Both identical units 25 are also located mirror symmetrical to plane 11 but could also be offset relative to each other in direction 17 like points 16.

The respective slide 23 is entirely spaced from and located below plane 10. Slide 23 comprises a plate-shaped base 30 oriented at right angles to plane 10 as well as to direction 17. Base 30 is reciprocatingly travellable on rails 31 of frame 22 exclusively in directions 18. Rails 31 are located upstream of points 16 and are rigidly secured to that side of cross member 24 which faces the points 16. Like base 30, the superimposed rails are also spaced from this side. Rotatably mounted on the base 30 at the corresponding plate side are runner or tracking rollers 32 which are positively guided by the rails 31. Hence with respect to directions transverse to plane 10 and parallel to direction 17 the slide 23 is mounted with zero clearance. Instead of rollers other runners 32 may also be provided.

For the transverse movement of slides 23 a common drive 33 is provided which is located adjacent to the cited side of the cross member 24 and, like the latter, is located below plane 10. It is also conceivable to provide separate drives for both slides 23 or units 25 so that these can be moved or pivoted independently of each other or asynchronously or simultaneously. In this case, sections 7, 9 of strip 4 or 5 could be laterally offset with respect to each other while maintaining the predetermined width.

Drive 33 comprises a driving member 34 located at the cited side between rails 31 and between cross member 24 and base 30. Driving member 34 is an endless circulating toothed belt 34 which is sliplessly guided over two guide pulleys 35 located adjacent to the insides of the frame cheeks. The two first and second circumferential sections or runs of the tooth belt 34 are oriented parallel up to the guide pulleys 35 and lie parallel to plane 10 or directions 18. These runs are superimposed since the axes of the guide pulleys 35 are oriented parallel to plane 10 and to direction 17. The guide pulleys are rotatably mounted on cross member 24. The upper run is secured by a clip 36 or the like to the one slide 23 in a mode resistant to tensile stress. The lower run is secured to the other slide 23 so that the counter movements of the runs are directly transferred to the slides 23. The securing fixtures 36 permit stepless adjustment of slides 23 relative to driving member 34 in the opposing directions 18. Clips 36 are secured to base 30 on the same side as runners 32.

For each rail 31 two runners 32 are provided in sequence so that slide 23 is mounted safe from tilting. The runners 32 located one above the other are guided by longitudinal rail edges facing away from each other. Each edge of the rail 31 forms running flanks adapted to the grooves of the runners 32 and oriented at an angle to each other. One of the guide pulleys 35 is driven by a setting motor or geared motor 37, the motor axis of which is oriented at right angles to plane 10 and the geared output of which is located in the axis of this guide pulley 35. The motor 37 is secured to cross member 24.

The two heads 26, 27 of the respective unit 25 or the carriers or mounts of the tools 28 and 29 thereof are rigidly connected to each other via a carrier 40. Carrier 40 transverses plane 10 at right angles exclusively on that side of points 16 which faces away from the slide bearing. Carrier 40 thus traverses plan 10 downstream of the transverse discharge of strips 5. Hence, beam 40 can be located downstream of the associated point 16 in an extension of the corresponding strip 5 without disturbing.

On the rear side or underside of plane 10 and in the height level of lower rail 31 and of the lower run of belt 34, the beam 40 forms an angular or U-shaped bracket oriented parallel to plane 10. This bracket has legs 38, 39 differing in length. From axis 20, which is located downstream of base 30, a first arm 38 protrudes towards plane 11, while being rotatably mounted in axis 20 by a bearing 45. With spacings from and between axis 20 and plane 11 an arm 39 rigidly connects to arm 38 and protrudes in direction 17. An arm 41 directed away from plane 11 and traversing axial plane 12 of axis 20 connects to arm 39 with a spacing from arm 38 in direction 17.

On the side of plane 12 which faces away from plane 11 the free end of arm 41 connects to an arm 42 which traverses plane 10 with a slight spacing from and ahead of the deflection of strip 5. Arm 42 traverses plane 40 at right angles and linearly. With a spacing above plane 40 this into an arm 43 oriented upstream. The arm 43 carries at it's free end and with spacings between the vertical stand 42 and plane 14 a carrier body, such as a plate 44, which protrudes beyond arm 43 upwards and towards plane 11. Head 27 is nondestructively releasably secured to the plate 44 which is oriented transverse at right angles to plane 10. Head 26 is rigidly connected to the lower carrier hoop, for example only to arm 39, by a box or angle-shaped holder or the like. Hence, in operation, both heads 26, 27 form a rigid unit which is swivable about axis 20, for example the intersection line of planes 12, 14 or 13, 14.

Slides 23 could also be guided downstream of rails 31, for example in the region of stand 42, by a further rail 31 to take its weight at this location. Thereb carrier 40 could be swivably guided above the rail on a supporting plate of base 30.

The cited unit with the tools 28 and 29 could be configured self-aligning or self-steering, e.g. by the axis 20 of the associated point 16 being arranged sufficiently far upstream so that the tools are drawn or entrained by mount 45. For the steering movement, however, pivot motor means 46, for example a piston/cylinder unit, is provided which may be disposed parallel to plane 10 and with a spacing below plane 10 roughly in the plane of the carrier hoop or of arm 39. In plan view this unit is always inclined with respect to directions 17, 18. One end of drive 46 is pivotably mounted in a bearing 47 and directly at base 30. The other end is pivotably mounted in a bearing 48 which is arranged at the carrier hoop or at the outer side of its U-shaped cross leg 39 at a location closely juxtapose with section 41. Drive 46 is optionally drivable in both opposing directions with a fluid to increase or decrease the spacing between bearings 47, 48. The pivot axes of bearings 47, 48 lie parallel to axis 20.

It is conceivable to provide one or both tools 28 and 29 without a direct drive so that they are driven for example only by the relative feed movement between material 2 and tool, or are rigidly mounted. Here a drive 49 is provided directly for tool 28. This drive is rigidly connected to arm 39 with the cited holder. The motor 53 of drive 49 is oriented at right angles transverse to plane 14 and parallel to plane 10 while being spaced from and located below plane 10 directly at the upper side of the hoop or arm 39. The shaft of this motor 53 is directed against base 30 and drives a gearing 54 carried solely by motor 53. Tool 28 is replaceably disposed on the output shaft of the gearing. This shaft is located in axis or plane 14. Motor 53 and the angular gearing 54 form commonly with tool 28 the head 26 which is arranged non-destructively releasable on carrier 40. The other tool 29 is rotatably driven counter tool 28 by engaging material 2 and tool 28. Therefore tool 29 does not require a separate driving motor, although such a motor could be provided.

For limiting the steering deflection of unit 25, 26, 40 as a whole stop means 50 are provided. They are located with a spacing below plane 10 at the hight level of carrier hoop 38, 39, 41 or below the carrier hoop respective drive 49. Drive 49 in turn overengaging the upper side of this hoop. A stop 51 is provided on carrier 40 or on the hoop. Stop 51 is rigidly fixed to an extension of arm 38. The extension protrudes beyond the outside of arm 39. Rigid stops 52 are secured to base 30 on both sides in the motion path of stop 51. Stop 51 is pivotable about axis 20 and parallel to plane 10. Stops 52 are located below hoop 38, 39, 41 and drive 46. After unit 25, 26, 40 has been pivoted over angle 21 from the center position shown by plane 15 in FIG. 5 the associated stop face of stop 51 is resiliently in contact with the associated stop 52 due to the pneumatic drive. Stop 52 is adjustable relative to base 30. One stop is mounted directly on base 30 and the other on a stop hoop which protrudes beyond base 30 in direction 17 and which is located on the same side of base 30 as the entire carrier 40 as well as drives 46, 49. In the stop position unit 26, 27, 40 is rigidly oriented.

The rotary bearing 55 for tool 29 is mounted with a bearing 5*b* to be displaceable relative to carrier 40 and tool 28 parallel to direction 18. Bearing 55 is manually movable in this shifting direction by a gearing, for example by a pinion or the like mating with a gear rack. Bearing 55 is manually lockable by clamping means in the position set in each case. The two interengaging slide members of the bearing 56 are interchangeable with unit 27 since the slide guide is interchangeably secured on side of plate 44 facing components 30, 31. Bearing 55 is mounted on the slide of bearing 56 to be manually adjustable at right angles transverse to plane 10 relative to tool 28 and carrier 40. Thereby as a positioning drive a spindle drive may be provided parallel to plane 15.

Tool 28 is mounted by gearing 54 only at its end side facing plane 11 and not at the other end side. The first named end side is located in plane 12 or 13 and overlappingly engages the larger end face of tool 29 which likewise is mounted only at one side. Due to the described, compact and dimensionally highly rigid configuration the slides 23 can be approximated to each other almost up to mutual abutting. Points 16 are located in those end faces of the two tool sets 28, 29 which face each other.

For guiding the material 2 in the region as well as upstream and downstream of point 16 leading means 60 are provided. They include fixed and movable leading members 58, 59 which provided for example table or sliding faces for the material 2 which may be formed by plates of sheet metal. Leading member 58 is stationary relative to frame 22, extends symmetrically on both sides of plane 11 and may be secured to cross member 24 while freely projecting in direction 17. The supporting or sliding face of member 58 is located in plane 10. One leading member 59 is also rigidly connected to each transversely travelling unit, for example to the slide base 30 thereof. The supporting or sliding face of member 59 is set back relative to the sliding face of 58 merely by the thickness of the latter.

In direction 17 members 58, 59 extend maximally up to carrier stand 42, with respect to which the free end of member 59 is set back further than the free end of member 58. These ends form deflections rounded in the shape of a quarter circle for guiding strip 5 at the free end of member 59 away from plane 10 downwards in the manner as described. Leading member 58 also covers the cross member 24 and leading member 59 covers rails 31 with rollers 32. Both leading members 58, 59 may also substantially cover tool 28 while being traversed by the circumferential zone of tools 28, 29 in the vicinity of point 16. For this purpose leading member 58 comprises a window extending in direction 18 so that it does not obstruct the transverse adjustment. Leading member 59 comprises for this purpose a window closely adapted to the circumferential sector of tool 28. By its edge facing plane 11 the leading member 59 underclasps the other leading member 58 in each position. Members 58, 59 are always located between the side cheeks of frame 22. The deflection of strips 5 occurs upstream of stands 42. Carriers 40 are, as viewed in direction 17, U-shaped and not mounted on frame 22 above plane 10.

Due to the configuration as described the deflection always occurs laterally past motor 53, gearing 54 and arm 39 into a region located under these. Same also applies to section 41, at the inside of which strip 5 is guided past downwards. Hence strip 5 can be guided past carrier 40 without coming into contact with it.

Varying the useful width of strip 4 or 5 or sideshifting of point 16 may be fully automated by control means 61 so that for sequencing a side-shift all that is needed is to enter manually or from sensor control a corresponding command to the electronic control means 61. Control means 61 contain an electronic processor 62, the control functions of which can be manually varied by means of an input 64 and/or with a programmable unit 65. The processor 62 acts via signal leads directly or with the interposition of an interface 66 on drives 37, 46, 49 so that following the input of a command the associated driven members 23, 25, 28, 29 implement the motions necessary for the transverse displacement, which motions are adapted to each other and to the longitudinal feed while superimposing each other.

The gear motor 37 contains control means, e.g. an encoder or incremental counter or transmitter 63 for electronic control of the rotary speed, the rotary phase and of a motor brake with respect to both opposing directions of rotation. These control means 63 are affected by processor 62 via a signal lead. The converter 66 actuates fluid valves for controlling drives 46 in both opposing drive directions.

As an example processor 62 receives a command for increasing the spacing between the parallel cutting planes 12, 13 nearly at the end of a working program to adapt the width of strip 4 to wider packaging units to be packaged in the packing station. As soon as the web length of strip 4 between points 16 and the packing station has attained a length sufficient to package the narrower packaging units still to be processed, the processor 62 controls drives 46 so that the spacing between bearings 47, 48 is reduced with shortening of drives 46, the material 2 thereby continuing to run.

Units 25 rock about axes 20 from the center position through angle 21 until stop 51 abuts against stop 52 fixed directly to base 30. Hence planes 12, 13 diverge counter direction 17 or relative to plane 11. On commencement of the pivot motion or simultaneously, drive 33 is thus controlled that the two slides 23 move away from each other and from plane 11 at the same speed. This movement occurs at a speed proportional to the tangent of angle 21 according to the equation Vq=Vm×tang 21 where Vq is the transverse speed of the individual slide 23 and Vm the more than zero running speed of material 2 parallel to direction 17.

Once units 25 have attained the predetermined spacing from each other or from plane 11, slides 23 are halted by the brake of drive 33 and drives 46 return units 25 into their center position in which they can then be positively locked also relative to each associated slide 23 by a latch separate from drive 46 or by stops. In this center position planes 12, 13 are again oriented parallel to plane 11. As soon as the slantingly cut intermediate section 8 located between the two longitudinal sections 7, 9 of constant width of strip 4 arrives in the region of the packing station it is guided past this station as waste and the wider longitudinal section of constant width is available for processing as packaging material.

During these actions the strip 5 is guided away continuously transverse to plane 10. Heads 26, 27 of tools 28 and 29 do not require motor drives to move them transverse to plane 10 relative to carrier 40. They may be manually moved away from plane 10 and out of mutual engagement, for example by setting drive 57.

A sensor 67 may be provided downstream directly adjacent to point 16 for sensing the quality of processing or the like. This sensor 67 is located above plane 10 and is secured above the latter to carrier 40 or stand 42 so that it can be adjusted transverse to each of planes 10 to 15 and relative to point 16. The two end positions of each slide 23 are fixed by stop means or switches 68 which are actuated by the same cam 69 in the respective end position. Cam 60 overengages rails 31 and belt 34. Cam 69 is fixed to that side of base 30 which faces away from unit 25. Limit switches 68 may be fixed to cross member 24 and are connected via signal leads to processor 62. Hence drive 33 is instantly halted on attaining the end position.

It will be appreciated that all effects and properties, such as position definitions etc. may be provided precisely or merely roughly or substantially as described. The positions define relative to reference bases, for example planes or axes 10 to 15, point 16, directions 17 to 19 and axis 20 may also be provided converse with respect to the respective reference base.

What is claimed is:

1. A device for processing ply material including paper, said ply material defining a layer plane, a center plane oriented at right angles with respect to the layer plane and a length direction, comprising:

a stationary device base;

first and second transverse slides simultaneously displaceable in first and second contour directions on said device base, said second contour direction opposing said first contour direction and said contour directions oriented transverse to said length direction and parallel to said layer plane;

first and second working units, each of said working units including respective first and second tool units in an operating state, from opposing sides of the ply material said first and second tool units simultaneously processingly engaging the ply material at first and second working points, said tool units defining first and second working planes oriented transverse to the ply material and transverse to said first and second contour directions, said first working unit being pivotably mounted on said first transverse slide about a first contour axis through said first working point and oriented transverse to said layer plane, said second working unit being pivotably mounted on said second transverse slide about a second contour axis through said second working point and oriented transverse to said layer plane; and, control means for commonly positionally varying said first and second working units with respect to said device base while in said operating state, said control means including:

a driving member for driving said first and second transverse slides respectively in simultaneous and opposing first and second transverse motions, said first transverse motion being in said first contour direction and said second transverse motion being in said second contour direction, a setting motor for uni-directionally driving said driving member and simultaneously counter-directionally displacing both said first and second transverse slides, and a pivot motor means for simultaneously counter-directionally pivoting said first working unit about said first contour axis and said second working unit about said second contour axis, the center plane being located between said first and second contour axes.

2. The device according to claim 1, wherein:

said control means advances the ply material substantially parallel to the length direction and synchronously and continuously positionally varies said first and second tool units with respect to the ply material in said contour directions, each of said first and second tool units including opposing tool boundaries for substantially commonly directly engaging the ply material from both sides of the ply material, each said tool boundaries being commonly displaceable in said contour directions.

3. The device according to claim 1, wherein tensioning means are provided for longitudinally tensioning the ply material when in said operating state, said tensioning means also acting as feeding means for conveying the ply material substantially parallel to the length direction while said tool unit directly engages the ply material, said control means being provided for displacing said tool unit transverse to the length direction while said tool unit directly engages the ply material, for processingly receiving the ply material said tool unit including a working gap bounded by opposing gap boundaries, said gap boundaries directly contacting the ply material when in said operating state.

4. The device according to claim 1, wherein:

each said first and second tool units includes lower and upper rotary tools commonly directly engaging the ply material at respective working points when in said operating state, said pivot motor means synchronously pivots said first and second tool units respectively about said first and second contour axes with respect to the ply material.

5. The device according to claim 1, wherein said tool unit is a length cutter for cutting the ply material parallel and transverse to the length direction, said length cutter including opposing first and second cutting tools, in cross section transverse to the length direction said first cutting tool overengaging said second cutting tool transverse to the layer plane.

6. The device according to claim 1, wherein each of said first and second transverse motions defines a motion path having a median path section and upstream and downstream path-end sections, said median path section connecting to and being located between said upstream and downstream path end sections, each of said transverse motions having a constant motion speed for said median path section and accelerated speeds for said upstream and downstream path end sections, said accelerated speeds including an increasing speed for said upstream path end section and a decreasing speed for said downstream path end section, said control means pivoting said first and second working unit about said first and second contour axes substantially only when said first and second transverse slides move over at least one of said upstream and downstream path end sections.

7. The device according to claim 1, wherein tensioning means are provided for longitudinally tensioning the ply material when in said operating state and for conveying the ply material substantially parallel to the length direction while said tool unit directly engages the ply material, said control means being provided for displacing said tool unit transverse to the length direction while said tool unit directly engages the ply material, for processingly receiving the ply material said tool unit including a working gap bounded by opposing gap boundaries, said gap boundaries directly contacting the ply material when in said operating state.

8. The device according to claim 1, wherein feeding means are provided for conveying the ply material substantially parallel to the length direction while said tool unit directly engages the ply material, said control means being provided for displacing said tool unit transverse to the length direction while said tool unit directly engages the ply material, for processingly receiving the ply material said tool unit including a working gap bounded by opposing gap boundaries, said gap boundaries directly contacting the ply material when in said operating state.

9. The device according to claim 1, wherein said driving member is rotationally driven, said driving member including a first circumferential section for driving said first transverse slide in said first contour direction, said driving member including a second circumferential section remote from said first circumferential section for driving said second transverse slide in said second contour direction.

10. The device according to claim 9, wherein said driving member includes a belt running over a first guide pulley and a second guide pulley spaced from said first guide pulley, said belt having said first and second circumferential sections, said circumferential sections being located between said guide pulleys, said first transverse slide being fixed to said first circumferential section and said second transverse slide being fixed to said second circumferential section.

11. The device according to claim 1, further comprising opposing tool boundaries directly connecting to said working zone, wherein the layer plane defines remote plane sides including a first plane side and a second plane side opposing said first plane side, both said tool boundaries being commonly supportingly connected to said device base exclusively on said first plane side, said tool unit including a support unit traversing the layer plane laterally of the ply material, said support unit separately supporting said tool boundaries on either of said plane sides.

12. The device according to claim 11, wherein said support unit (30, 40) includes a base support (30) supportedly connected to said device base (22) and a tool unit support (40) separate from said base support (30) and supportedly connected to said base support (30), only said tool unit support (40) supporting said tool boundaries commonly displaceable with respect to said base support (30) and said device base (22), said base support (30) being supported on a cross-slide (23) located entirely on said first plane side and displaceably with respect to said device base (22) transverse to said working plane (12, 13).

13. The device according to claim 1, wherein said tool unit includes opposing tool boundaries commonly directly engaging the ply material at said working zone, a layer support separate from said tool boundaries being included for supporting the ply material adjacent to said tool boundaries and said working zone, said layer support being at least partly positionally variable commonly with said tool unit.

14. The device according to claim 13, wherein downstream of said working zone (16) said tool unit (26, 27) includes a support member (42) traversing the layer plane (10), between said working zone (16) and said support member (42) a transverse guide being provided for guiding a layer section (5) transverse to the layer plane (10) and the length direction (17).

15. The device according to claim 1, wherein said control means are provided for continuously angularly displacing said working plane with respect to the length direction up to a setting angle, a conveying motion defining a conveying speed of the ply material with respect to said working zone being defined, said control means positionally varying said tool unit with a cross-speed transverse to said conveying motion, said cross-speed being substantially equal to the tangent of said setting angle multiplied by said conveying speed.

16. The device according to claim 15, wherein said control means are provided for uninterruptedly machining the ply material at said working zone while said tool unit varies from machining the ply material parallel to the length direction to transverse to the length direction and back to parallel to the length direction.

17. The device according to claim 1, wherein said control means are provided for superimposing simultaneous first and second control motions between said tool unit and the ply material, said first control motion being oriented parallel to the length direction and said second control motion being oriented transverse to said first control motion and substantially parallel to the layer plane, said tool unit including a machining gap directly connecting to said working zone and machiningly receiving the ply material.

18. The device according to claim 17, wherein said first control motion is a motion of the ply material with respect to said device base and said second control motion is a motion of said tool unit with respect to said device base, said tool unit including a first machining tool and a second machining tool substantially engaging said first machining tool in the vicinity of said working zone, said first and second machining tools bounding said machining gap.

19. The device according to claim 17, further defining an actual motion resulting from said first and second control motions, said actual motion defining an actual direction, wherein said control means are provided for orienting said working plane substantially permanently parallel to said actual direction, said tool unit being pivotally mounted about a control axis oriented transverse to the layer plane and substantially traversing said working zone, said machining gap including opposing gap boundaries commonly pivotable about said control axis.

20. The device according to claim 17, wherein for motor-drivingly performing said second control motion a crossslider (23) is mounted on said device base (22), said cross-slide (23) and said working unit (25), including a working base (26, 27, 40) reversibly and continuously displaceably parallel to said second control motion along a guide (31) of said device base (22), said machining gap being bounded by tool boundaries including a machining tool (28, 29) said working unit (25) including motor drive means (49) for driving at least one of said tool boundaries to perform a machining motion separate from said first and second control motions, at least one of said tool boundaries being positionally variable transverse to said working plane (12, 13) independent from said other tool boundary and with respect to said cross-slide (23).

21. The device according to claim 1, wherein the layer plane defines remote plane sides including a first plane side and a second plane side remote from said first plane side, said first and second tool units each including separate first and second machining tools for directly and commonly machiningly engaging the ply material, said first machining tool adjacent said first plane side and said second machining tool adjacent said second plane side, said control means for synchronously displacing both said first and second machining tools transverse to said first and second working planes, tensioning means being included for longitudinally tensioning the ply material while said pivot motor means are simultaneously pivoting said first working unit about said first contour axis.

22. The device according to claim 21, wherein said first and second working points are located in a common transverse plane oriented at right angles with respect to the layer plane and the length direction, said pivot motor means including a first pivot motor mounted on said first transverse slide and a second pivot motor mounted on said second transverse slide, said first pivot motor pivoting said first working unit to achieve first contour angles with respect to the center plane, said second pivot motor pivoting said second working unit to achieve second contour angles with respect to the center plane, said first and second pivot motors being provided for keeping said first and second contour angles permanently equal.

23. The device according to claim 21, wherein stop means are included for resiliently stop limiting said first and second working units when pivoted with said pivot motor means.

24. The device according to claim 21, wherein each of said first and second tool units includes lower and upper rotary tools commonly directly engaging the ply material at one of said first and second working points, at least one of said rotary tools being displaceable and lockable transverse to the layer plane, said rotary tools defining lower and upper axial planes oriented at right angles with respect to said layer plane, said lower axial plane of said lower rotary tool being displaced parallel to the length direction with respect to said upper axial plane of said upper rotary tool.

* * * * *